United States Patent [19]

Lowery et al.

[11] 4,169,772

[45] Oct. 2, 1979

[54] ACID ZINC PLATING BATHS, COMPOSITIONS USEFUL THEREIN, AND METHODS FOR ELECTRODEPOSITING BRIGHT ZINC DEPOSITS

[75] Inventors: Richard K. Lowery, Garfield Heights; William J. Willis, North Royalton, both of Ohio

[73] Assignee: R. O. Hull & Company, Inc., Cleveland, Ohio

[21] Appl. No.: 958,124

[22] Filed: Nov. 6, 1978

[51] Int. Cl.[2] ..... C25D 3/22

[52] U.S. Cl. ..... 204/55 R

[58] Field of Search ..... 204/55 R, 55 Y, 43 Z, 204/114

[56] References Cited

U.S. PATENT DOCUMENTS

| | | | |
|---|---|---|---|
| 2,791,554 | 5/1957 | Winters | 204/55 Y |
| 3,227,638 | 1/1966 | Burnson | 204/55 Y X |
| 3,655,534 | 4/1972 | Kampe | 204/55 R |
| 3,806,431 | 4/1974 | Koch | 204/55 Y |
| 3,849,325 | 11/1974 | Kampe | 204/55 Y X |
| 3,878,069 | 4/1975 | Todt et al. | 204/55 R |
| 3,974,045 | 8/1976 | Takahashi et al. | 204/55 R |
| 4,075,066 | 2/1978 | Eckles et al. | 204/55 R |
| 4,076,600 | 2/1978 | Huebner | 204/55 R |

*Primary Examiner*—G. L. Kaplan

*Attorney, Agent, or Firm*—Maky, Renner, Otto & Boisselle

[57] ABSTRACT

An aqueous acidic plating bath for the electrodeposition of a bright zinc deposit on a substrate is disclosed and comprises zinc ions and an amount, sufficient to provide a level and bright deposit, of at least one bath-soluble composition obtained by the reaction of a nitrogen-containing heterocyclic compound with formaldehyde, an epihalohydrin or glycerol halohydrin and at least one amino compound selected from the group consisting of (i) ammonia, (ii) an aliphatic amine, or (iii) an amidine. Additionally, the plating baths of the invention may contain a nitrogen-containing compound obtained by the reaction of ammonia, an aliphatic amine containing at least one primary amine group, or mixtures thereof with one or more epihalohydrins, glycerol halohydrins or mixtures thereof. Thioureas and anionic aromatic sulfonic acids or salts thereof also are contemplated as being useful in the plating baths of the invention. Methods for depositing a bright zinc coating over a wide range of current densities also are described.

23 Claims, No Drawings

ACID ZINC PLATING BATHS, COMPOSITIONS USEFUL THEREIN, AND METHODS FOR ELECTRODEPOSITING BRIGHT ZINC DEPOSITS

BACKGROUND OF THE INVENTION

The invention relates to the electrodeposition of zinc, and particularly to a plating bath for plating bright level zinc deposits from aqueous acid plating baths. More particularly, the invention relates to the incorporation in the acid zinc baths of at least one bath-soluble composition obtained by the reaction of a nitrogen-containing heterocyclic compound with formaldehyde, an epihalohydrin or glycerol halohydrin, and at least one amino compound selected from the group consisting of (i) ammonia, (ii) an aliphatic amine, or (iii) an amidine. The invention also relates to methods for electrodeposition of level zinc deposits from such baths.

Considerable attention has been directed over the years to the development of zinc electroplating baths which will produce bright and level deposits of improved quality. Much research has been devoted to improving the overall brightness, the range of allowable current densities, and ductility of the zinc deposit. Until recently, most of the successful zinc plating baths were aqueous alkaline zinc plating baths containing substantial quantities of cyanide which has caused concern regarding toxicity and waste disposal problems.

Accordingly, activity in the plating area has been devoted either to the development of cyanide-free alkaline plating baths or improvements in acid plating baths. This invention relates to acid plating baths.

Typically, acid plating baths have been based on a suitable inorganic zinc salt such as zinc sulfate, and the baths usually include buffers such as the corresponding ammonium salt and other additives to promote and improve ductility, brightness, throwing power and covering power. Surface active agents may be included to improve crystal structure, reduce pitting, and increase the solubility of the other additives.

U.S. Pat. No. 4,076,600 is an example of a patent relating to acid zinc plating baths and the invention therein relates to the use of compositions containing phosphorus cations as leveling agents. The baths also may contain small amounts of nitrogen-containing compounds obtained by reacting (a) ammonia, an aliphatic amine containing at least one primary amine group, or mixtures of two or more of any of these with (b) one or more epihalohydrins, glycerol halohydrins or mixtures thereof. The use of bath-soluble reaction products obtained by the reaction of a nitrogen-containing heterocyclic compound with an acyclic amine having at least two functional groups separated by at least one different group, formaldehyde and an epihalohydrin or glycerol halohydrin in alkaline zinc electroplating baths is described in U.S. Pat. Nos. 3,655,534 and 3,849,325.

SUMMARY OF THE INVENTION

The present invention relates to the discovery that a bright and level zinc electrodeposit can be obtained from aqueous acid plating baths containing zinc ions and an amount, sufficient to provide a level and bright deposit, of at least one bath-soluble composition obtained by the reaction of a nitrogen-containing heterocyclic compound with formaldehyde, an epihalohydrin or glycerol halohydrin, and at least one amino compound selected from the group consisting of (i) ammonia, (ii) an aliphatic amine, or (iii) an amidine. The nitrogen-containing heterocyclic compound may be either an unsaturated or a saturated nitrogen-containing heterocyclic compound. In addition to the above compounds, the acid zinc plating baths of the invention also may contain nitrogen-containing compounds obtained by reacting ammonia or an aliphatic amine containing at least one primary amine group with epihalohydrins or glycerol halohydrins, at least one thiourea compound and anionic aromatic sulfonic acids or salts thereof.

DESCRIPTION OF THE PREFERRED EMBODIMENTS

The compositions of the invention which particularly are useful as leveling agents for the aqueous acidic plating baths of the invention are prepared by reacting a nitrogen-containing heterocyclic compound with formaldehyde, an epihalohydrin or glycerol halohydrin, and at least one amino compound selected from the group consisting of (i) ammonia, (ii) an aliphatic amine, or (iii) an amidine. These compositions have been found to be particularly effective for depositing bright zinc coatings from aqueous acid zinc plating baths.

The nitrogen-containing heterocyclic compounds used to form the leveling agents of the invention can be either unsaturated or saturated nitrogen-containing heterocyclic compounds. Examples of unsaturated nitrogen-containing heterocyclic compounds include imidazoles, pyridines, pyrazines and pyrazoles which may be substituted or unsubstituted. Bicyclic heterocyclic compounds such as quinoline and isoquinoline derivatives also are contemplated as being useful in the invention.

The imidazoles which are useful in the invention generally will have the formula

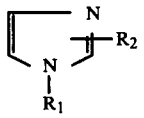

wherein $R_1$ is hydrogen, alkyl, acyl, vinyl, amino acid, or a 1-carbonyl imidazole group, and $R_2$ is hydrogen, alkyl, or an aryl group. Examples of such imidazoles include: imidazole, 1-vinyl imidazole, 1,2-dimethyl imidazole, histidine, 4-phenyl imidazole, 1-methyl imidazole, 1-ethyl imidazole, 2-methyl imidazole, 1-acetal imidazole and 1,1'-carbonyldiimidazole.

The pyrazole compounds which are useful in the invention have the general formula

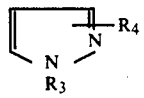

wherein $R_3$ is hydrogen or an alkyl group and $R_4$ is hydrogen or an alkyl or one or more carboxyl groups. Examples of such pyrazoles include: pyrazole, 3-methyl pyrazole and 3,5-pyrazole dicarboxylic acid.

The pyridine compounds which are useful have the general formula

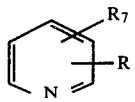

wherein R and $R_7$ are each independently hydrogen, halogen, vinyl, cyano, amino, alkyl, aminoalkyl, hydroxy, hydroxyalkyl, carboxyalkyl, or carboxyl groups. Examples of such pyridines include: pyridine, 3-picoline, 4-picoline, 3-picolyl amine, 4-pycolyl amine, 3 cyano pyridine, 3-chloro pyridine, 4-vinyl pyridine, 2,6-pyridine dimethanol, 3 amino pyridine, 4 hydroxy pyridine, 2-pyridineethanol, 2-pyridine carboxaldehyde, 2-pyridylacetic acid, 4-pyridine carboxaldehyde, 3-pyridine carboxylic acid (nicotinic acid), 3,5-pyridine dicarboxylic acid, the corresponding 2,3-, 2,4-, 2,5-, 2,6- and 3,4-dicarboxylic acids.

The pyrazine compounds which are useful have the general formula

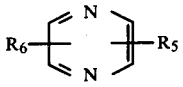

wherein $R_5$ and $R_6$ are each independently hydrogen, alkyl, acyl, aminoalkyl, alkoxy, hydroxyalkyl, carboxyalkyl, carboxy or amide groups. Specific examples of such pyrazines include: pyrazine, pyrazineamide, 2-methyl pyrazine, 2,5-dimethyl pyrazine, 2-acetyl pyrazine, 2-pyrazine carboxylic acid, 2-ethoxy, 3-ethyl pyrazine, 2,3-pyrazinedicarboxamide and 2,3-pyrazinedicarboxylic acid.

The saturated nitrogen-containing heterocyclic compounds which may be used in the preparation of the leveling compounds of the invention may be a piperizine, a piperidine or a morpholine compound which may be substituted or unsubstituted. Examples of piperizines which are useful in the preparation of the compositions generally will have the formula

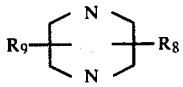

wherein $R_8$ and $R_9$ each are independently hydrogen, or a lower alkyl group. Specific examples include piperizine, 2-methyl piperizine, 2-ethyl piperizine, N-methyl piperizine and 2,5-dimethyl piperizine.

Examples of suitable piperidine compounds include piperidine, 1 acetyl piperidine, 1-amyl piperidine, 1,2-dimethyl piperidine, 2-ethyl piperidine, and 3-methyl piperidine, etc. Examples of morpholine compounds include morpholine, N-methyl morpholine, N-ethyl morpholine, etc.

The amino compounds useful in the preparation of the leveling compounds of the invention may be one or more of the following: (i) ammonia, (ii) an aliphatic amine, or (iii) an amidine. The ammonia may be added as such or as ammonium hydroxide.

The aliphatic amines which are useful may be either acyclic or cyclic amines although the acyclic amines are preferred. An example of a cyclic amine which is useful is hexamethylene tetramine. The acyclic aliphatic amines may be either primary amines, secondary amines or tertiary amines, and these amines may contain other functional groups such as hydroxyl groups.

Preferably, the aliphatic amine useful in the formation of the leveling agents of the invention will be an acyclic aliphatic amine having two or more functional groups. The two or more functional groups may be —OH, —NH and —$NH_2$ groups, and should be separated by one or more different groups or atoms in the amine molecule. Examples of the aliphatic amine reactants include alkylene polyamines having the general formula $$H_2N\text{-(Alkylene NH)}_x\text{Alkylene NH}_2$$

wherein x is an integer from 0 to 4, and alkylene may be a straight or branched chain group containing up to about 6 carbon atoms. Examples of such alkylene polyamines containing at least one primary amine group include ethylene diamine, triethylene tetramine, propylene diamine, N-ethyl-ethylene diamine, tripropylene tetramine, tetraethylene pentamine and pentaethylene hexamine.

Examples of the aliphatic amines containing other groups include monoethanolamine, diethanolamine, triethanolamine, etc. An additional example of an aliphatic amine is 3-dimethyl amino propyl amine.

The amino compound also may be a compound containing the amidine group —C(=NH)$NH_2$. Such compounds also may be referred to as carboxamidines when regarded as derivatives of the carboxylic acid group and replacement of OH with $NH_2$ and of =O with =NH. The amidine compounds may be represented by the formula $$R-\overset{\overset{\displaystyle NH}{\|}}{C}-NH_2$$

wherein

R is hydrogen, hydroxyl, an aliphatic, alicyclic, aromatic, heterocyclic, amino, amidino, amidinoaryl, carboxyalkyl or —NHR' group wherein R' is an aliphatic, alicyclic, aminoalkyl, amidoalkyl or carboxyalkyl group.

The acid salts such as the formates, acetates, hydrochlorides, carbonates, etc. of such amidines also are useful in the invention. The aliphatic and alkyl groups contain from one to 10 or more carbon atoms, whereas the alicyclic and aromatic groups contain from 6 to 20 or more carbon atoms.

Examples of such amidines are as follows. The list is exemplary only and is not to be considered as a limitation on the above formula.

| | Examples | |
|---|---|---|
| R = | Formula | Name |
| Hydrogen | H—C(=NH)$NH_2$ | formamidine |
| Hydroxyl | HO—C(=NH)$NH_2$ | isourea |
| Aliphatic | $CH_3C(=NH)NH_2$ | ethanamidine |
| | $CH_3CH_2CH(CH_2CH_3)-CH_2CH_2C(=NH)NH_2$ | 4-ethylhexanamidine |

-continued

| | | |
|---|---|---|
| Alicyclic | 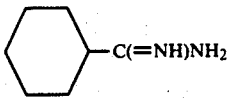 | cyclohexanecarboxamidine |
| | 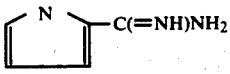 | pyrrole-2-carboxamidine |
| Heterocyclic | 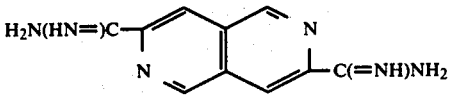 | 2,6-diazonaphthalene-3,7-dicarboxamidine |
| Aromatic | 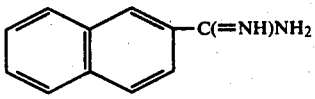 | 2-naphthamidine |
| | 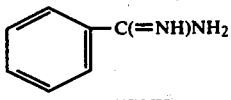 | benzamidine |
| Amino | $H_2N—C(=NH)NH_2$ | guanidine |
| Aminoalkyl | $H_2NCH_2CH_2C(=NH)NH_2$ | 1-aminopropanamidine |
| Amidinoalkyl | $H_2N(HN=)C(CH_2)_3C(=NH)NH_2$ | pentanediamidine |
| Amidino | $H_2N(HN=)C—C(=NH)NH_2$ | ethanediamidine |
| Amidinoaryl | 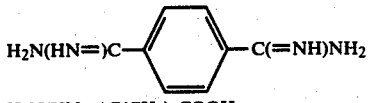 | 1,4-benzenedicarboxamidine |
| Carboxyalkyl | $H_2N(HN=)C(CH_2)_3COOH$ | 4-carbaminidoylbutanoic acid |
| R' = | | |
| Aliphatic | $CH_3NH\ C(=NH)NH_2$ | methyl guanidine |
| Alicyclic | 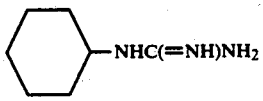 | cyclohexyl guanidine |
| Amidino | $H_2N(HN=)C—NH—C(=NH)NH_2$ | biguanide |
| Aminoalkyl | $H_2N(CH_2)_4NH—C(=NH)NH_2$ | aminobutylguanidine |
| Carboxylalkyl | $H_2N(HN=)C—NH—CH_2COOH$ | 3-guanidinoacetic acid |
| | $H_2N(HN=)C—NH—(CH_2)_2COOH$ | 3-guanidinobutanoic acid |
| amidoalkyl | $H_2N(HN=)C—NH—CH_2CH_2CONH_2$ | 3-guanidino propionamide |
| Heterocyclic | 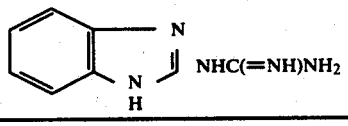 | 2-guanidinobenzimidazole |

Since the brightener compositions of the invention generally are prepared in water or water-alcohol mixtures, the formaldehyde used in the reaction generally is an aqueous solution which is commercially available as Formalin. Formaldehyde generators such as paraformaldehyde, trioxane, etc., may be utilized in the process as a source of formaldehyde.

The epihalohydrins that are useful in the preparation of the compositions of the invention include epihalohydrins and derivatives of epihalohydrins having the formula

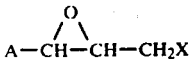

wherein A is hydrogen or a lower alkyl group of from one to about five carbon atoms, and X is halogen. Examples of such compounds include epichlorohydrin, epibromohydrin and 1-chloro-2,3-epoxybutane. Epichlorohydrin is preferred. Other compounds having similar reactivity to the epihalohydrins such as glycerol halohydrins having the following formula may be utilized.

$$CH_2X—CHX—CH_2X$$

wherein at least but not more than two of the X's are hydroxy groups and the remaining X's are chlorine or bromine. Examples of such reactants include, for example, 1,3-dichloro-2-hydroxypropane, 3-chloro-1,2-dihydroxypropane and 2,3-dichloro-1-hydroxypropane.

The reaction of the nitrogen-containing heterocyclic compound with the amino compound, formaldehyde and epihalohydrin or glycerol halohydrin may be conducted at any temperature between room temperature and the reflux temperature of the mixture. Obviously, shorter reaction times will be required at the reflux temperature. The reaction preferably is carried out in water, alcohol, or a water-alcohol mixture such as a water-ethanol mixture.

The amounts of the reactants included in the reaction mixture may vary although the molar ratio of the nitrogen-containing heterocyclic compound, amino compound, formaldehyde, and epihalohydrin or glycerol-halohydrin within the range of from about 0.1:0.5:1.0:0.5 to about 0.5:1.5:3.0:1.5 is preferred. In one preferred embodiment, the bath-soluble composition is obtained by the addition of formaldehyde to a heated mixture of the heterocyclic nitrogen-containing compound in the amino compound followed by the addition of the epihalohydrin or glycerol halohydrin. As mentioned above, examples of some of the bath-soluble compositions wherein the amino compound is an aliphatic amine are described in U.S. Pat. Nos. 3,849,325 and 3,655,534.

The following examples illustrate the preparation of the bath-soluble compositions which are particularly useful as brightener additives in the aqueous acid zinc electroplating baths of the invention. Unless otherwise indicated, all parts and percentages are by weight.

EXAMPLE 1

A mixture of 500 ml. of water, 93 grams of 4-picoline and 60 grams of ethylene diamine is prepared and warmed to about 50°–60° C. whereupon 82 ml. of Formalin is added dropwise with stirring. After the addition is completed, the mixture is maintained at the reflux temperature for one hour and then cooled to 50°–60° C. Epichlorohydrin (92 grams) is added very slowly, and the mixture is heated at the reflux temperature for 30 minutes. After cooling, the reaction product is ready for use or may be diluted with water.

EXAMPLE 2

A mixture of 60 cc. of water, 9.3 grams of 3-picoline and 14.0 grams of hexamethylene tetramine is prepared and warmed to about 50° C. whereupon 8.2 ml. of Formalin is added dropwise. The mixture is maintained at the reflux temperature for about 45 minutes. Epichlorohydrin (9.2 ) grams) is added very slowly and the refluxing continued for 1.5 hours. The reaction product is recovered on cooling of the mixture.

EXAMPLE 3

A mixture of 50 cc. of water, 6.8 grams of imidazole and 9.5 grams of guanidine hydrochloride is prepared and warmed to about 60° C. whereupon 8.2 ml. of a 37% aqueous formaldehyde solution is added dropwise. The mixture is maintained at the reflux temperature for an additional 30 minutes. Epichlorohydrin (9.2 grams) is added very slowly and the refluxing is continued for one hour. The cooled reaction product is ready for use.

EXAMPLE 4

A mixture of 50 cc. of water, 8.6 grams of piperizine and 10.2 grams of 3-dimethylaminopropyl amine is heated to a temperature of about 60° C. whereupon 16.4 ml. of Formalin is added dropwise. The mixture is maintained at the reflux temperature for about 45 minutes. After cooling the mixture to about 70° C., 13.8 grams of epichlorohydrin is added very slowly, and the mixture is heated at the reflux temperature for 90 minutes. On cooling, the desired reaction product is obtained.

EXAMPLE 5

A mixture of 60 cc. of water, 12.3 grams of pyrazinamide and 6.1 grams of ethanolamine is heated to about 50° C. whereupon 8.2 ml. of Formalin is added dropwise. The mixture is heated and maintained at the reflux temperature for about 30 minutes. Epichlorohydrin (9.2 grams) then is added slowly and the refluxing conditions continued for one hour. On cooling, the reaction product is recovered.

EXAMPLE 6

A mixture of 50 cc. of water, 9.4 grams of 1-vinyl imidazole and 12 grams of ammonium hydroxide is heated to about 60° C. whereupon 8.2 ml. of 30% aqueous formaldehyde is added dropwise. After completion of the addition of the formaldehyde, the mixture is maintained at the reflux temperature for 30 minutes. Epichlorohydrin (27.6 grams) is added very slowly and the refluxing conditions are maintained for 90 minutes.

EXAMPLE 7

The procedure of Example 1 is repeated except that the 4-picoline is replaced by an equivalent amount of N-methylmorpholine.

EXAMPLE 8

The procedure of Example 5 is repeated except that the ethanolamine is replaced by an equivalent amount of hexamethylene tetramine.

EXAMPLE 9

The procedure of Example 1 is repeated except that the epichlorohydrin is replaced by an equivalent amount of 1,3-dichloro-2-hydroxypropane.

As mentioned above, bath-soluble compositions of the type illustrated in Examples 1–9 are useful as brightening additives in aqueous acidic zinc plating baths. In general, the amount of the composition to be included in the acid zinc plating baths will be an amount sufficient to provide a bright and level deposit, and more particularly, will be an amount to provide a concentration of the composition in the bath of from about 0.25 to about 50 grams per liter. In most instances, the amount of brightener contained in the bath preferably will be from about 0.25 to about 2 to 3 grams per liter of bath.

The aqueous acidic zinc plating baths to which the compositions of the invention may be added as brighteners include the conventional zinc plating baths known to those skilled in the art. Such baths contain free zinc ions and are prepared with zinc sulfate, zinc chloride, zinc fluoborate and/or zinc sulphamate. The zinc plating baths normally will contain conducting salts and boric acid. Examples of conductive salts utilized in the acid zinc plating baths of the invention include sodium chloride, sodium fluoride, ammonium fluoride, ammonium chloride, etc. Boric acid which normally is included in the zinc plating baths of the invention serves as a weak buffer to control the pH and the cathode film. The boric acid also is helpful in smoothing the deposit and is believed to have a cooperative effect with the leveling agents of the invention. The concentration of boric acid in the bath is not critical and generally will be in the range of from about 10 to about 60 grams per liter. The inorganic salts of zinc such as zinc sulfate heptahydrate may be present in the plating baths of the invention in amounts ranging from about 200 to about 600 grams per liter. The conductive salts such as the ammonium or sodium fluoride are present in amounts ranging from about 10 to about 30 grams per liter or more.

Examples of typical acidic zinc plating baths to which the brightener compositions of the invention may be added are as follows:

Bath No. 1

-continued

| | | |
|---|---|---|
| | $ZnSO_4 \cdot 7H_2O$ | 380 g/l |
| | $Na_2SO_4$ | 70 g/l |
| | $MgSO_4$ | 60 g/l |
| | pH | 3.5 |
| Bath No. 2 | | |
| | $ZnSO_4 \cdot H_2O$ | 267 g/l |
| | NaCl | 15 g/l |
| | $H_3BO_3$ | 15 g/l |
| | pH | 2.5 |

The properties of the zinc deposited by the baths of the invention may be enhanced further by including other additives in the bath such as a small amount of (B) a nitrogen-containing compound obtained by reacting (a) ammonia, an aliphatic amine containing at least one primary amine group, or mixtures of two or more of any of these with (b) one or more epihalohydrins, glycerol halohydrins or mixtures thereof. Generally, from about 0.25 to about 5 g/l of such nitrogen-containing compound in the zinc plating bath results in improved properties for the zinc deposit. The preparation of such nitrogen-containing compounds is described in, for example, U.S. Pat. Nos. 2,791,554 and 4,076,600.

Examples of aliphatic amines which are useful for preparing these nitrogen-containing compounds include the aliphatic acyclic amines such as methylamine, ethylamine, propylamine, butylamine, etc., and alkylene polyamines having the general formula $$H_2N(\text{Alkylene NH})_x\text{Alkylene NH}_2$$

wherein x is an integer from 0 to 4 and the alkylene may be of a straight or branched chain group containing up to about six carbon atoms. Examples of such alkylene polyamines include ethylene diamine, triethylene tetramine, tripropylene tetramine, hexamethylene tetramine and pentaethylene hexamine. Combinations of ammonia with one or more of the alphatic amines can be reacted with the epoxy compound as well as combinations of aliphatic acyclic amines. Alternatively, mixtures of the reaction product of ammonia with an epoxy compound with the reaction product of an amine with an epoxy compound can be added to the plating baths.

The epihalohydrins and glycerol halohydrins which may be reacted with the ammonia or the above described primary amines have been described earlier with respect to the formation of the brightening compositions obtained from the nitrogen-containing heterocyclic compounds. Various ratios of the reactants may be selected although it is preferred generally to react ammonia or the aliphatic amines containing one primary amine group with epihalohydrin or glycerol halohydrin at a molar ratio of at least 2:1. The reaction between the aliphatic amines containing two primary amine groups such as ethylene diamine with epihalohydrin is conducted with molar ratios of at least about 1:1 and ratios of up to about 2:1 have been found to be particularly useful. More specifically, the nitrogen-containing compounds are prepared by mixing the ammonia or amine compound with water in a reaction vessel followed by the addition of the epihalohydrin or glycerol halohydrin while maintaining the reaction mixture below about 60° C. In U.S. Pat. No. 2,860,089, reaction products of epichlorohydrin and ammonia or ethylene diamine are described. U.S. Pat. No. 3,227,638 describes the reaction product of epichlorohydrin and hexamine.

The acid zinc plating baths of the invention also may contain (C) at least one thiourea compound having the formula $$(R'_2N)_2C{=}S$$

wherein each R' is independently hydrogen, an alkyl or an alkenyl group. In addition to thiourea, the substituted thioureas of the type included within the formula include, for example, allyl thiourea, N,N'-di-n-butyl thiourea, N,N'-diethyl thiourea, and 1,1,3,3-tetraethyl-2-thiourea. The amount of thiourea compound incorporated into the zinc plating baths of the invention may vary from about 0.01 to about 1 gram per liter.

Another ingredient in a preferred embodiment of the acid zinc plating baths of the invention is (D) at least one anionic aromatic sulfonic acid or salt thereof. The anionic aromatic sulfonic acids may be compounds obtained by the polycondensation of formaldehyde and an aromatic sulfonic acid which generally is a naphthalene sulfonic acid. Condensation products of this type which are useful in the plating baths of the invention have the formula

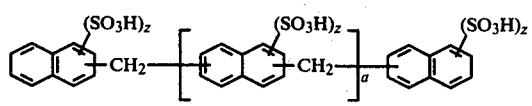

and/or

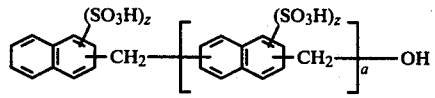

wherein z is an integer from 1 to 3 and a is an integer from 1 to 14, preferably from 2 to 6. Polycondensation products of this type are known compounds and their production is described in, for example, Houben-Weyl, "Methoden Der Organishen Chemie," Volume XIV/2 at page 316, and said description is hereby incorporated by reference. The utility of these condensation products in ammonium-containing acid zinc baths is described in U.S. Pat. No. 3,878,069 and in ammonia-free acid zinc baths in U.S. Pat. No. 4,075,066. Compounds of this type are available commercially from the GAF Corporation.

The general method of preparing these polycondensation products involves reaction of a formaldehyde solution with naphthalene sulfonic acid at a temperature of from about 60° to about 100° C. until the formaldehyde odor has disappeared. Similar products can be obtained by sulfonation of naphthalene formaldehyde resins. The condensation products obtained in this manner contain two or more naphthalene sulfonic acids linked by methylene bridges which can have from one to three sulfonic acid groups.

Some examples of aromatic sulfonic acids which may be used include: a bath-soluble salt of tetrahydronaphthalene sulfonic acid such as those available commercially from DuPont; a bath-soluble salt of a xylene sulfonic acid such as those available from Arco Chemical Company under the general trade designation "Ultrawet"; and a bath-soluble salt of cumyl sulfonic acid.

These anionic aromatic sulfonic acid compounds may be introduced into the plating baths either in their acid form or as the water-soluble salts which may be the sodium or potassium salts. The amount of the anionic polycondensation product included in the acid plating baths may be varied depending upon the other ingredients in the plating bath but should be any amount which is effective to improve the brightness, ductility and malleability of the zinc deposit obtained from the baths. Generally up to about 15 grams of the salt may be used per liter of plating bath.

The acid zinc electroplating baths of the invention may be utilized to produce zinc deposits on all types of metals and alloys, for example, on iron, zinc die cast, copper and brass. The zinc plating baths of the invention may be employed in all types of industrial zinc plating processes including still plating baths, high-speed plating baths for strip or wire plating, and in barrel plating.

The acidic zinc plating baths of the present invention deposit a level zinc deposit on substrates at any conventional temperature such as from about 25° to about 60° C. Still plating baths generally will be operated at a lower range of the temperature such as from about 25° to about 40° C. whereas high-speed plating baths for strip or wire plating may be operated over the entire range of from about 25° to about 60° C. The acidity of the bath may vary from a pH of from about 1.5 to about 6 or 7. If desired, the pH of the bath may be lowered by the addition of acid solutions such as a 10% sulfuric acid solution. If the pH falls below the desired operating range, it may be increased by the addition of ammonium hydroxide.

The following examples illustrate the aqueous acidic zinc plating baths of the invention.

EXAMPLE A

Bath No. 1 to which is added:
- 1.5 g/l of the product of Example 1, and
- 0.6 g/l of thiourea.

EXAMPLE B

Bath No. 2 to which is added:
- 1 g/l of the reaction product of Example 3,
- 0.3 g/l of thiourea,
- 0.2 g/l of the reaction product of ammonia and epichlorohydrin (mole ratio 2:1),
- 1.5 g/l of sodium xylene sulfonate

EXAMPLE C

Bath No. 1 to which is added:
- 2 g/l of the reaction product of Example 4,
- 1 g/l of the reaction product of ethylene diamine with epichloro hydrin (mole ratio 1:1)
- 0.3 g/l of methyl-3-hydroxyethyl thiourea,

EXAMPLE D

Bath No. 1 to which is added:
- 1.5 g/l of the reaction product of Example 6,
- 0.3 g/l of thiourea,

EXAMPLE E

Bath No. 1 to which is added:
- 1 gram of the product of Example 2,
- 1.5 g/l of sodium cumyl sulfonic acid,

EXAMPLE F

Bath No. 2 to which is added:
- 2 g/l of the reaction product of Example 5, and
- 1.5 g/l of the reaction product of ammonia and epichlorohydrin (mole ratio 2:1)

EXAMPLE G

Bath No. 2 to which is added:
- 1 g/l of the reaction product of Example 1,
- 0.6 g/l of thiourea, and
- 0.2 g/l of the reaction product of ammonia and epichlorohydrin (mole ratio 1.5:1)

EXAMPLE H

Bath No. 1 to which is added:
- 1.5 g/l of the reaction product of Example 6,
- 0.4 g/l of thiourea, and
- 1.5 g/l of sodium xylene sulfonate.

EXAMPLE I

Bath No. 1 to which is added:
- 1.5 g/l of the reaction product of Example 3,
- 0.6 g/l of thiourea,
- 1 g/l of the reaction product of ethylene diamine with epichlorohydrin (mole ratio 1:1), and
- 1 g/l of sodium xylene sulfonate.

The utility of the plating baths of the invention is demonstrated by plating steel Hull Cell panels in a 267 ml. Hull Cell. Current densities are measured with a Hull Cell scale. In the following tests, the panels are plated at 5 amperes for 3 minutes from a D.C. rectifier. The solutions are mechanically agitated. The results of the tests are summarized in the following table:

| Plating Baths | Results |
|---|---|
| Example A | Very bright, level zinc plate above 10 ASF |
| Example B | Very bright, level zinc plate above about 20 ASF |
| Example C | Bright, level zinc plate above 20 ASF |
| Example D | Very bright, level zinc plate above about 15 ASF |

In practice, the improved aqueous zinc plating baths of the invention may be operated on a continuous or intermittent basis, and from time to time, the components of the bath have to be replenished. The various components may be added singularly as required or may be added in combination. The amounts of the various additive compositions to be added to the plating baths may be varied over a wide range depending on the nature and performance of the zinc plating bath to which the composition is added. Such amounts can be determined readily by one skilled in the art.

The embodiments of the invention in which an exclusive property or privilege is claimed are defined as follows:

1. An aqueous acidic plating bath for the electrodeposition of a bright zinc deposit on a substrate which comprises zinc ions and (A) an amount, sufficient to provide a level and bright deposit, of at least one bath-soluble composition obtained by the reaction of a nitrogen-containing heterocyclic compound with formaldehyde, an epihalohydrin or glycerol halohydrin, and at least one amino compound selected from the group consisting of (i) ammonia, (ii) an aliphatic amine, or (iii) an amidine.

2. The plating bath of claim 1 wherein the nitrogen-containing heterocyclic compound is an unsaturated nitrogen-containing heterocyclic compound.

3. The plating bath of claim 2 wherein the unsaturated nitrogen-containing heterocyclic compound is an imidazole, a pyridine, a pyrazine or a pyrazole compound.

4. The plating bath of claim 1 wherein the nitrogen-containing heterocyclic compound is a saturated nitrogen-containing heterocyclic compound.

5. The plating bath of claim 4 wherein the saturated nitrogen-containing heterocyclic compound is a piperazine, a piperidine or a morpholine compound.

6. The plating bath according to any one of claims 1-5 wherein the amino compound is an acyclic amine having at least two functional groups.

7. The plating bath of claim 6 wherein the functional groups are each independently —$NH_2$, —NH or —OH.

8. The plating bath according to any one of claims 1-5 wherein the amino compound is an amidine having the general formula $$R—C(=NH)NH_2$$

or the acid salts thereof wherein

R is hydrogen, hydroxyl, an aliphatic, alicyclic, aromatic, heterocyclic, amino, amidino, amidenoaryl, carboxy alkyl or —NHR′ group wherein R′ is an aliphatic, alicyclic, aminoalkyl, aminoalkyl, or carboxyalkyl group.

9. The plating bath of claim 8 wherein the amino compound is a guanidine.

10. The plating bath according to any one of claims 1-5 wherein the bath-soluble composition is obtained by the addition of formaldehyde to a heated mixture of the heterocyclic nitrogen-containing compound in the amino compound followed by the addition of the epihalohydrin or glycerol halohydrin.

11. The plating bath according to any one of claims 1-5 wherein the bath-soluble composition is obtained by the reaction of a nitrogen-containing heterocyclic compound with an amino compound, formaldehyde and an epihalohydrin wherein the molar ratio of the reactants is from about 0.1:0.5:1.0:0.5 to about 0.5:1.5:3.0:1.5.

12. The plating bath according to any one of claims 1-5 wherein the bath also contains (B) from about 0.25 to about 5 g/l of a nitrogen-containing compound obtained by reacting ammonia, an aliphatic amine containing at least one primary amine group, or mixtures thereof with one or more epihalohydrins, glycerol halohydrins or mixtures thereof.

13. The plating bath of claim 12 wherein the aliphatic amine containing at least one primary amine group is represented by the formula $$H_2N(\text{Alkylene NH})_x\text{Alkylene NH}_2$$

wherein X is an integer from 0 to 4 and the alkylene may be a straight or branched chain group containing up to six carbon atoms.

14. The plating bath of claim 12 wherein the bath also contains (C) at least one thiourea compound having the formula $$(R'_2N)_2C{=}S$$

wherein each R′ is independently hydrogen, an alkyl or any alkenyl group.

15. The plating bath according to claim 14 wherein the bath also contains (D) at least one anionic aromatic sulphonic acid or salt thereof.

16. The method of electrodepositing a bright zinc coating on a substrate which comprises electroplating said substrate in the aqueous acidic zinc bath of claim 15.

17. The method of electrodepositing a bright zinc coating on a substrate which comprises electroplating said substrate in the aqueous acidic zinc bath of claim 14.

18. The plating bath according to claim 12 wherein the bath also contains (D) at least one anionic aromatic sulphonic acid or salt thereof.

19. The method of electrodepositing a bright zinc coating on a substrate which comprises electroplating said substrate in the aqueous acidic zinc bath of claim 18.

20. The method of electrodepositing a bright zinc coating on a substrate which comprises electroplating said substrate in the aqueous acidic zinc bath of claim 12.

21. The plating bath according to any one of claims 1-5 wherein the bath also contains (D) at least one anionic aromatic sulphonic acid or salt thereof.

22. The method of electrodepositing a bright zinc coating on a substrate which comprises electroplating said substrate in the aqueous acidic zinc bath of claim 21.

23. The method of electrodepositing a bright zinc coating on a substrate which comprises electroplating said substrate in an aqueous acidic zinc bath according to any one of claims 1-5.

* * * * *